United States Patent [19]

Cory

[11] Patent Number: 4,690,576

[45] Date of Patent: Sep. 1, 1987

[54] AUTOMATIC RIBBON RE-INKER

[76] Inventor: John S. Cory, 1436 View Pointe Ave., Escondido, Calif. 92027

[21] Appl. No.: 818,474

[22] Filed: Jan. 13, 1986

[51] Int. Cl.[4] ..... B41J 31/14; B41J 32/00

[52] U.S. Cl. ..... 400/200; 400/202.3

[58] Field of Search ..... 400/191, 197, 200, 202.2, 400/202.4, 202.3, 202, 202.1

[56] References Cited

U.S. PATENT DOCUMENTS

| | | | |
|---|---|---|---|
| 3,937,178 | 2/1976 | Newman | 400/202.4 X |
| 4,091,913 | 5/1978 | Ku et al. | 400/202.4 X |

FOREIGN PATENT DOCUMENTS

| | | | |
|---|---|---|---|
| 2935027 | 3/1981 | Fed. Rep. of Germany | 400/202.4 |
| 3325917 | 2/1985 | Fed. Rep. of Germany | 400/200 |
| 173190 | 10/1982 | Japan | 400/202.4 |
| 49292 | 3/1983 | Japan | 400/202.4 |
| 219080 | 12/1983 | Japan | 400/202.4 |

*Primary Examiner*—Edgar S. Burr
*Assistant Examiner*—James R. McDaniel

[57] ABSTRACT

The operational lifetime of a standard ink ribbon cassette or other ribbon transport device is significantly extended by the addition, to a standard cassette, of a inexpensive reservoir and a feeder means. The configuration claimed uses the ribbon driver means, provided in all standard cassettes, as a demand valve, blocking ink flow to the ribbon except when ink is being removed from the ribbon by printing. The demand valve transports ink to the ribbon from a wick type feeder, which is supplied by a absorptive, saturated, reservoir. The reservoir shape, size, and absorptive material, and the feeder, are matched to the requirements of each printer, to control ink flow to the demand valve at a rate closely matching the rapid rate of ink removal from the ribbon by the printing operation.

6 Claims, 1 Drawing Figure

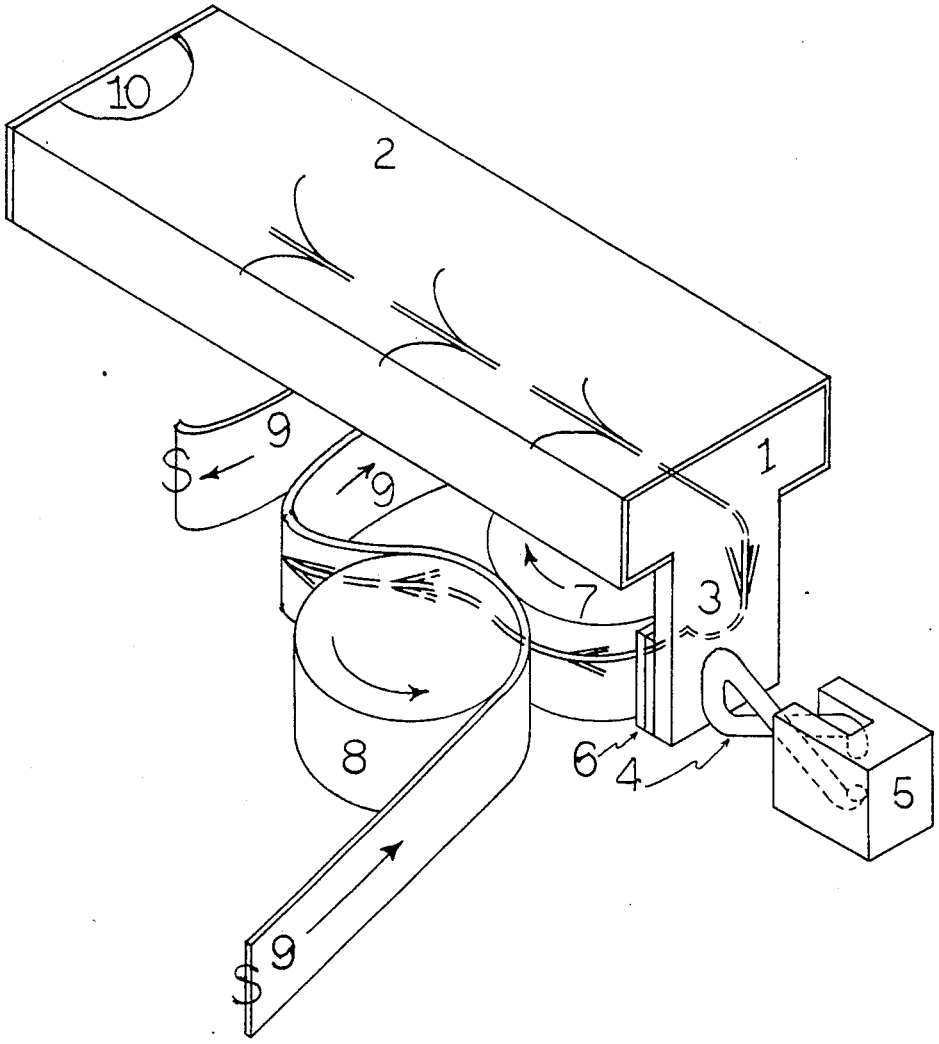
10
2
9
$
9
1
7
3
8
6
4
5
9
$

AUTOMATIC RIBBON RE-INKER

CROSS REFERENCES TO RELATED DISCLOSURES

The subject matter of this invention was disclosed on Mar. 13, 1985, to the U.S. Patent Office under the Disclosure Document Program and was assigned the Disclosure Document Number 136037.

BACKGROUND OF THE INVENTION

1. Field Of The Invention

This invention relates to the addition, during the printing process, of ink to ribbons being used in an impact printer, such as a typewriter or dot matrix printer, and is specifically applicable to the field of inked ribbon cassettes.

2. Description Of Prior Art

A century of experience has proved inked ribbons are a superior method of supplying the ink to impact printers. This technique, however, has two major limitations which have been the subject of many inventions: (1) The quantity of ink the ribbon can hold is small, so the ribbon must be frequently discarded or re-inked at considerable cost; and, (2) The amount of ink transferred by the impact depends on the amount of ink on the ribbon, so even the small ink load on a ribbon cannot be completely used by multiple passes, before the quality of the impact printing declines.

Considerable prior art in the printing industry has alleviated these limitations by using a mechanism comprising an ink reservoir, a feeder, and a roller to apply ink to the ribbon and thereby extend the inked ribbon lifetime. Since the proliferation of high speed dot matrix printers using throw-away, inked ribbon, cassettes, the utility of reducing the life cycle costs of cassettes has motivated similar inventions adapted to cassettes. Each invention uses one or more of the components (reservoir, feeder, and roller) in a unique combination to add ink to a ribbon.

Such prior art is exemplified by patents by Castro (U.S. Pat. No. 4,390,294), Ogan (U.S. Pat. No. 4,364,678), and Okamura (U.S. Pat. No. 4,449,838). Castro provides a device, separate from the printer and cassette, for adding ink to the ribbon. This alternate to simply replacing the entire cassette, or re-loading the cassette with an inked ribbon, can reduce ribbon costs by a factor of ten, but requires a messy operation, interuption of the printing process, and no relief from the decline, with use, of print quality.

Ogan provides a felt pad ink reservoir, inside the cassette, in continuous contact with the ribbon. This eliminates the messy operation, but, because of the limited space available inside a standard cassette, adds only a small fraction to ribbon lifetime. In addition, if the pad is heavily loaded with ink to maximize the lifetime improvement, the pad, in continuous contact with the stationary ribbon when the printer is not in operation, will locally saturate the ribbon, and produce unacceptably non-uniform print.

Okamura provides a larger reservoir, and an additional transfer roller (restricted by claims to . . . turned by contact friction with the ribbon . . . ) to control the flow rate from the reservoir to the ribbon. Successive step increases in roller-reservoir pressure increase the flow as the reservoir is depleted. In addition, the roller acts as a demand valve, feeding ink to the ribbon only when the ribbon is moving, to avoid local over-inking and allowing maximum ink storage in the reservoir by permitting saturation of the reservoir. Both the reservoir, and the roller with its springs to control ink flow, are located inside the cassette. The space required by the reservoir and the roller is obtained at the expense of space normally filled, in a standard cassette, with ink-containing ribbon, so, any increase in lifetime is restricted to the excess of ink capacity of the reservoir over the ink capacity of a slightly larger volume of ribbon. This invention cannot be adapted to existing cassettes.

SUMMARY OF THE INVENTION

The primary object of the present invention is to provide a modified inked ribbon cassette with a longer operational lifetime, and consequent lower life cycle cost. A secondary objective is to allow the printer operator to control the print density.

The present invention, as in prior art, adds an ink reservoir, a feeder, and a transfer roller to a standard inked-ribbon cassette (which comprises means for containing the inked ribbon, transporting the ribbon past the impact print head, and mounts on existing dot matrix printers). In operation, ink flow from the reservoir, through the feeder, to the transfer roller, which transports the ink to the ribbon when, and only when the ribbon is moving.

In contrast with prior art, the present invention fits onto existing cassettes, the transfer roller is one of the existing ribbon transport pinch rollers, and the reservoir may be located outside the cassette. In addition, the reservoir absorptive material, size, and shape are closely specified. The unique characteristics of this invention are the configuration, materials, and proportions, all used to control the rate of diffusive flow from the reservoir to the ribbon.

These unique characteristics provide an improvement over prior art. By adding the reservoir and feeder to existing cassettes, the manufacturing, cost, and functional advantages of each of the many cassette and other ribbon transport designs used on different printers are conserved. By using the existing pinch rollers to transfer ink from the feeder to the ribbon only when the ribbon is moving, cassette modification is minimized, and reliability improved.

The greatest improvement over prior art is provided by the reservoir design. The reservoir size, shape, and absorptive material are specified to simultaneously satisfy two competing criteria. (1) The reservoir size, and absorptive capacity of the material are specified to provide a saturation ink load sufficient to at least quadruple the operational lifetime of the cassette with a single charge of ink. With available absorptive materials, this requires a significantly larger reservoir than provided by prior art. (2) Given the required reservoir size, the shape and diffusivity of the material are specified to maintain an ink flow rate to the ribbon nearly equal to the rapid ink removal rate from the ribbon by dot matrix printers, by maintaining a high ink concentration in the feeder.

DESCRIPTION OF THE DRAWING

FIG. 1 is a perspective view which shows the ink flow path from the reservoir to the ribbon.

DESCRIPTION OF THE PREFERRED EMBODIMENT

The objective of the invention is to provide a simple, inexpensive addition to existing inked ribbon transport means which will increase the operating lifetime of such means many-fold by replacing the ink on the ribbon at nearly the same rate it is removed by the printing process, and also, provide a means for controlling the average level of the print darkness. Ink replacement at nearly the same rate it is removed maintains a uniform ink load on the ribbon, and consequently provides uniform print darkness. Control of the ink flow rate provides control of the ink load on the ribbon, and thereby control of the print darkness. The invention achieves this objective by providing a metered ink flow from a reservoir to the ribbon.

FIG. 1 illustrates the ink flow to the ribbon in the application of the invention to an inked-ribbon cassette, such as used by a high speed dot matrix printer. An ink-absorptive material 1, forms an ink reservoir, and is contained and protected by container 2, which may be mounted on the top of most standard cassettes. Ink may be added to the reservoir through hole 10. Ink is transferred from the reservoir material 1, to the pre-existing pinch roller 7, by a feeder means, comprising the tab 3, the pad 6, the spring 4, and the restrainer 5. The tab 3, which may be an extension of reservoir material, wicks ink from the reservoir to a location near one of the pre-existing pinch rollers, which is located inside the cassette. A friction pad 6, fastened to the tab 3, conducts ink to the pinch roller 7. A spring 4, presses the friction pad 6, against the pinch roller 7, with the force required to transfer ink to the pinch roller 7 at nearly the same rate as ink is being removed from the ribbon by the printing process. Rotation of the roller 7 exerts a sideways force on the pad 6 and the tab 3 which are held in place by an opposing sideways force from spring 4. A restrainer means 5, is bonded to the cassette case and exerts both a pressing and a sideways force on the spring 4.

The subsequent ink flow is carried by mechanical elements pre-existing in the cassette to be modified. Each cassette which can be improved by the present invention comprises an inked ribbon, a means for maintaining tension on the ribbon, a case which fits in a particular impact printer and guides the ribbon past the printer impact head, a pair of pinch rollers used to move the ribbon past the printing impact head, and a means for driving one of the pinch rollers. One of the pinch rollers 7 must resist diffusive ink flow. In the improved cassette, the pre-existing rotation of the pinch roller 7, is also used to transport the ink deposited by the pad 6, to the region where the ribbon 9, is pinched between pinch rollers 7 and 8. The pre-existing force pinching the ribbon is also used to transfer the ink from the non-absorptive roller 7, to the ribbon. The ink is then mechanically moved to the impact printer head, where it is removed from the ribbon and deposited on paper.

The time rate of ink flow from the pinch roller to the ribbon is made to depend only on the rate of deposition on the pinch roller and the speed of the ribbon (which equals the surface speed of the pinch roller). This is achieved by requiring that the pinch roller 7 material allows only negligible diffusive ink flow. The pinch roller thereby acts as a demand valve, preventing ink flow to the ribbon except when the ribbon is moving, and ribbon ink is being removed from another part of the continuous loop ribbon by the printing process.

The rate of ink diffusion flow from the reservoir to the pinch roller 7 is determined by the geometry, size and shape of each element, the local ink concentration, concentration gradient, and diffusivity of each material. The relation between these variables and the diffusion ink flow rate is given by the diffusion partial differential equation. Solutions to this equation, for many geometries and boundary conditions, are given in the standard texts, such as Carslaw and Jaeger, "Conduction Of Heat In Solids", 2nd edition, Oxford University Press, 1959, 510 pages. Measurements have shown that the embodiment illustrated in FIG. 1 can be usefully approximated by the one dimensional solutions illustrated in FIGS. 17 and 19 of Chapter 3 of this text. These solutions show that the local concentration of ink (C) and rate of ink flow to tab-3 end of the reservoir (G), at any time (t), depends on the reservoir cross sectional area (A), the reservoir length (L), the diffusion constant (K), the initial ink flow rate (G0), and the initial ink concentration (C0).

Measurements on a typical (nominal 80 character per second dot matrix printer), shows that ink is removed from a new ribbon by the printing process at a rate of about 0.4 gram per hour. For a standard cassette, after about $\frac{1}{2}$ hour of printing, the ribbon ink concentration has declined so that the print darkness noticeably degrades, and the ink removal rate has declined to to about 0.2 grams per hour.

The selected design criteria for this embodiment of the invention, therefore, requires that the reservoir supply ink to the ribbon for about 2 hours of printing at a rate which does not fall below 0.2 grams per hour. These requirements can be expressed in terms of the equations of Carslaw and Jaeger as the requirement that at $t=2$ hours, $G/G0>\frac{1}{2}$.

From FIG. 17, this condition translates into the requirements that:

$$A\,L>2\,G0\,t\,/C0 \qquad (1);$$

and $$A/L>G0/C0/K \qquad (2).$$

These expressions place limits on the size, A L, and shape, A/L, of the reservoir in terms of the properties of the reservoir material. The reservoir of the invention is specifically limited to sizes and materials which satisfy the inequalities (1) and (2).

In the preferred embodiment, a nylon web material is suggested as the reservoir material. This material has a high measured ink saturation concentration (0.7 grams per cubic centimeter), so the initial concentration of ink ($C0=\frac{3}{4}$ of saturation) can be high. The measured diffusion constant is about 5.4 square centimeters per hour. With this material, and the design criteria, the inequalities (1) and (2) specify the limits on the reservoir size and shape of $A\,L>3$ cubic centimeters, and $A/L>0.141$ centimeters. Since the cassette size can accommodate a larger reservoir, the reservoir sizes selected are $A=3$ cm., and $L=6.2$ cm., or several times the lower limits specified by (1) and (2) to allow for the concentration gradient in the tab, and for faster (nominal 160 characters per second) printers.

The tab 3, is an extension of the reservoir material with as large a cross sectional area as compatible with the minimal modification of the pre existing cassette, 1.7 by 1.2 by 0.3 centimeters. This size is sufficient to conduct the ink from the externally mounted reservoir inside the cassette without an excessive concentration gradient.

The pad 6 consists of two layers of standard ½ inch printer ribbon, extending the full width of the tab. This pad can transfer ink from the tab to the existing cassette gear toothed pinch roller 7,, at a rate of 0.4 gm. per hour if compressed between the tab and the pinch roller with a force of about ½ pound. The spring 4 is designed by conventional means to provide this force with a compliance compatible with the manufacturing tolerances of the cassette.

The pre-existing pinch roller 7, is made of a nylon plastic, with negligible diffusivity for the dot matrix ink used with dot matrix printers.

What is claimed is:

1. An automatic ribbon re-inker improvement to a pre-existing inked-ribbon transport means for impact printers, comprising an inked ribbon, a ribbon transport means using pinch rollers, with at least one of said rollers constructed to essentially block diffusive ink flow, a pinch roller driver means, and a support means for its elements;

the improvement comprising an ink reservoir to store and dispense ink, constructed from an ink absorptive material, with a volume greater than eight times (a) the average initial ink usage rate preferred for the printer, times (b) the operational lifetime of the unmodified ribbon transport mechanism, divided by (c) the saturation concentration of the reservoir material, and, with a cross sectional area greater than the (a) reservoir length times (b) the average initial ink usage rate preferred for the printer divided by (c) the saturation concentration of the reservoir material divided by (d) the diffusivity of the reservoir material, a feeder tab to conduct ink by diffusion, extending from one end of the said reservoir to the ribbon drive surface of said diffusion blocking pinch roller of the inked-ribbon transport mechanism, a pressing force device forcing the said feeder tab against the inked-ribbon drive surface of the said ink diffusion blocking pinch roller, a restrainer device supporting one end of said pressing force device, to conduct both pressing and sideways forces from said pressing force device to the said support means for the elements of the said inked-ribbon transport mechanism.

2. An automatic ribbon re-inker in accordance with claim 1, wherein:

a pad is interposed between said feeder tab and said pinch roller to enhance ink flow from the said feeder pad to the said pinch roller, and provide a smooth, wear-resistant surface.

3. An automatic ribbon re-inker in accordance with claim 1 or 2, wherein the inked-ribbon transport mechanism to be improved is a cassette, for use with dot matrix printers, and, said reservoir volume is greater than 1.6 grams divided by the saturation ink concentration of the reservoir material, and, said reservoir cross sectional area is greater than 0.4 grams per hour times the reservoir length divided by the saturation ink concentration of the reservoir material, divided by the ink diffusivity of the reservoir material.

4. An automatic ribbon re-inker in accordance with claim 1 or 2 wherein:

the reservoir material is a woven nylon web with an ink saturation concentration greater than 0.7 grams per cubic centimeter and an ink diffusivity greater than 5.4 square centimeters per hour, and, the reservoir volume is greater than 11.5 cubic centimeters per gram, times the average initial ink usage rate preferred for the printer, times the operational lifetime of the unmodified ribbon transport mechanism, and, the reservoir cross sectional area is greater than 0.265 centimeter-hours per gram times the reservoir length times the average initial ink usage rate preferred for the printer.

5. An automatic ribbon re-inker in accordance with claim 3 wherein:

the reservoir material is a woven nylon web with an ink saturation concentration greater than 0.7 grams per cubic centimeter and an ink diffusivity greater than 5.4 square centimeters per hour, and, the reservoir volume is greater 2.29 cubic centimeters and, the reservoir cross sectional area is greater than 0.106 centimeters times the reservoir length.

6. An automatic ribbon re-inker in accordance with claim 5 wherein:

the feeder tab consists of an extension of the reservoir material, and, the pressing force device consists of a wire spring.

* * * * *